US006003598A

United States Patent [19]

Andreychuk

[11] Patent Number: 6,003,598

[45] Date of Patent: Dec. 21, 1999

[54] MOBILE MULTI-FUNCTION RIG

[75] Inventor: Mark T. Andreychuk, Cochrane, Canada

[73] Assignee: Cancoil Technology Corporation, Calgary, Canada

[21] Appl. No.: 09/002,375

[22] Filed: Jan. 2, 1998

[51] Int. Cl.[6] ..... E21B 19/22

[52] U.S. Cl. ..... 166/76.1; 166/77.1; 166/77.2; 173/185; 175/62

[58] Field of Search ..... 166/77.1, 77.2, 166/77.3, 76.1; 173/185; 175/162

[56] References Cited

U.S. PATENT DOCUMENTS

| | | | |
|---|---|---|---|
| 3,841,407 | 10/1974 | Bozeman | 166/315 |
| 4,036,508 | 7/1977 | Eddy et al. | 280/492 |
| 4,249,600 | 2/1981 | Bailey . | |
| 4,265,304 | 5/1981 | Baugh . | |
| 4,290,495 | 9/1981 | Elliston | 175/85 |
| 4,416,329 | 11/1983 | Tanner et al. | 166/68 |
| 4,585,061 | 4/1986 | Lyons, Jr. et al. . | |
| 4,591,006 | 5/1986 | Hutchison et al. | 175/52 |
| 4,616,454 | 10/1986 | Ballachey et al. | 52/115 |
| 4,673,035 | 6/1987 | Gipson | 166/77.2 |
| 4,756,366 | 7/1988 | Maroney et al. | 166/250 |
| 4,951,759 | 8/1990 | Richardson | 175/85 |
| 5,090,039 | 2/1992 | Gard et al. | 378/59 |
| 5,107,940 | 4/1992 | Berry | 175/162 X |
| 5,215,151 | 6/1993 | Smith et al. | 175/45 |
| 5,271,461 | 12/1993 | Decker et al. | 166/185 |
| 5,291,956 | 3/1994 | Mueller et al. | 175/67 |
| 5,348,096 | 9/1994 | Williams | 166/384 |
| 5,386,385 | 1/1995 | Koopmans | 166/77.1 |
| 5,411,085 | 5/1995 | Moore et al. | 166/242 |
| 5,439,066 | 8/1995 | Gipson | 175/61 |
| 5,839,514 | 11/1998 | Gipson | 166/77.2 X |
| 5,842,530 | 12/1998 | Smith et al. | 166/77.2 X |
| 5,845,708 | 12/1998 | Burge et al. | 166/77.3 |

*Primary Examiner*—George Suchfield
*Attorney, Agent, or Firm*—Thomas E. Malyszko

[57] ABSTRACT

A mobile hybrid rig adapted to run coiled tubing (CT) and wireline equipment for oil and gas wells can also accommodate conventional joined pipe for drilling of shallow wells. The rig incorporates: a chassis and power unit for rig transport; an adjustable platform with a number of hydraulically operated stabilizers for alignment to wellhead; a mast pivotable into slanted or vertical positions for CT operation with a Blow Out Preventer (BOP) and an injector; a cradle for supporting the injector and aligning it to the wellhead; a CT reel cartridge assembly adapted to running currently available CT reels; a winching facility for manipulating wireline equipment; and a control cabin for managing rig activities.

26 Claims, 9 Drawing Sheets

MOBILE MULTI-FUNCTION RIG

FIELD OF THE INVENTION

The present invention relates to drilling and servicing equipment for oil and gas wells generally, and in particular relates to a mobile rig for transporting and operating equipment for continuous coiled tubing drilling, for conventional joined pipe handling and drilling and for wireline applications.

BACKGROUND OF THE INVENTION

Drilling a well for tapping underground reservoirs of oil or gas is an expensive procedure that has made the petroleum exploration industry a competitive one where cost improving advancements are continually sought. Oil and gas drilling is currently most commonly accomplished with rotary rigs using conventional joined pipe sections. These rigs typically have jackknife type masts that are tall enough to handle up to 3 stands of joined pipe and thereby facilitate faster "trips" in and out of a well bore. Automatic pipe handling apparatuses have been proposed for simplifying this laborious and time-consuming task (as in U.S. Pat. No. 4,951,759 to Richardson for example), yet drilling procedures today remain very much the same for the past few decades.

Once drilling is finished and the casing has been cemented in the wellbore, the drilling rig is usually moved, and a smaller, truck-mounted service rig is brought in to complete the well. Completing a successful well, namely preparing it for production, typically includes the steps of running a casing into the well, installing a wellhead, and installing a production tubing string. Production tubing strings today may consist of continuous coiled tubing (referred to herein as "CT") carried on a spool on a service rig and which is injected inside the well casing using an injector head to straighten and push the tube down.

Mobile service rigs with a mast for handling conventional pipe sections have been proposed, yet most require separate transport for their masts and all are of limited application. For example, Elliston (U.S. Pat. No. 4,290,495) and Eddy et al. (U.S. Pat. No. 4,036,508) both describe a mobile rig incorporating a mast for effectively handling pipe strings in and out of a well. Neither Elliston nor Eddy offers a service rig adapted to handle other types of drilling or well servicing technology. Mobile rigs for doing continuous tubing drilling (CTD) also exist but most of the CT rigs in use today require the use of a separate crane to manipulate the blow-out-preventer (BOP) and injectors that are needed with this technology. Although there are rigs which have a collapsible mast along which an injector head can be raised or lowered without the need for a crane, such as in Baugh (U.S. Pat. No. 4,265,304), these rigs suffer from various shortcomings. For instance, Baugh is not adapted for servicing slant wells or accepting conventional joined pipe, nor can it perform other tasks such as wireline work. Such rigs also require time consuming removal of the injector head and/or the BOP off the mast for transporting the rig.

Current mobile drilling and service rigs suffer from the further disadvantages. They encounter difficulties in properly aligning the guide path of the mast's traveling block with the centerline of a well. Misalignments often result in undesireable forces and damage to the pipe being run into and out of the well. They also require laborious procedures when assembling a lubricator onto a wellhead. Further, CT service rigs have cartridge assemblies which are reel specific in that they can only handle a CT reel designed for that particular cartridge. Hence, CT must invariably be re-spooled from a shipping reel to the cartridge's work reel, wasting time and money. A CT unit operator typically needs to purchase an additional work reel for this purpose, which reel may cost up to US$100,000.

What is desired therefore is a novel multi-task rig which overcomes the many disadvantages of the prior art devices. The novel rig should be mobile and combine on a single platform the ability to transport and operate equipment for continuous coiled tubing drilling, conventional pipe drilling and wireline operations. In particular, the rig should have a pivotal derrick for vertical and slant well operations, and an ability to tilt more than 90 degrees. A CT injector should remain in the derrick at all times without removal for rig transport. The CT injector should be movable out of the plane of the derrick to free the derrick for running conventional joined pipe. The rig platform should be hydraulically movable to help align the derrick with the well, and the derrick's injector should further be maneuverable in 3 dimensions for alignment with the well. A cartridge assembly carried by the rig should be adjustable for receiving various sizes of CT reel. A wireline winch assembly should also be mountable on the platform and be wired to a control cabin for controlling the wireline equipment as well as most other rig systems from a single location.

SUMMARY OF THE PRESENT INVENTION

According to the present invention, there is provided in one a rig for drilling and servicing a well comprising:

- a mobile carrier;
- a mast mounted on said carrier, said mast including:
  - means for pivoting said mast between a transportation mode where said mast is in a reclined position for transporting said rig to said well, and an operating mode for inclining said mast generally parallel to said well for said drilling and servicing; and,
  - an injector slidable to selected positions along said mast for moving tubing into and out of said well;
- a cartridge assembly mounted on the carrier for holding a reel of continuous coiled tubing, said cartridge assembly including a means for guiding said coiled tubing between said reel and said injector;
- a winch assembly removably mounted on said carrier for holding and manipulating wireline equipment into and out of said well; and,
- a control cabin mounted on said carrier for controlling rig functions, including said mast, injector, cartridge assembly, coiled tubing, winch assembly, and wireline equipment.

In another aspect the invention provides a mobile rig for drilling and servicing an oil or gas well comprising:

- a self-propelled carrier;
- a mast mounted on said carrier, said mast including:
  - means for pivoting said mast between a lowered transportation position for transporting said rig to said well, and an raised operating position for inclining said mast to said well; and,
  - an injector having an operative position wherein said injector is movable to a plurality of selected locations along said mast for threading continuous coiled tubing into and out of said well, and an inoperative position wherein said injector is displaced away from said operative position to allow said mast to accept and operate conventional joined pipe.

In yet another aspect the invention provides a rig for drilling and servicing a well comprising:

a mobile carrier;

a mast mounted on said carrier, said mast including a means for pivoting said mast between a reclined position for transporting said rig to said well, and a raised position for inclining said mast generally parallel to said well, and an injector movable to selected positions along said mast for moving continuous coiled tubing into and out of said well;

a cartridge assembly mounted on the carrier for holding a reel of said coiled tubing, said cartridge assembly including a guide means for guiding said coiled tubing between said reel and said mast, and an adjustable frame means for accepting and holding a plurality of sizes of said reel; and, a control means for controlling the function of said mast, cartridge assembly and coiled tubing.

BRIEF DESCRIPTION OF THE DRAWING FIGURES

Embodiments of the invention will now be described, by way of example only, with reference to the accompanying drawings, wherein.

LIST OF REFERENCE NUMBERS IN DRAWINGS

Figure 3:
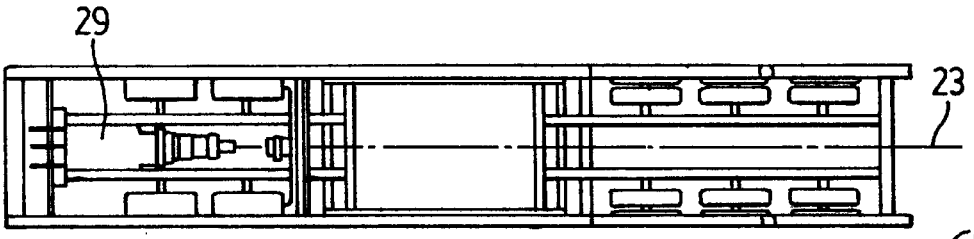
FIG. 3 is a plan view of the rig's carrier vehicle.

15 wellhead
20 rig
21 ground surface
22 carrier of rig 20
23 longitudinal axis of carrier 22
24 chassis of carrier 22
26 front end/axles of carrier 22
27 support for derrick 40
28 rear end/axles of carrier 22
29 engine of carrier 22
30 cab of carrier 22
32 stabilizers for chassis 24
34 lifters of stabilizers 32
36 extending beam of stabilizer 32
40 derrick
42 rails of derrick 40
44 top end of derrick 40
45 bottom end of derrick 40
46 winch atop derrick 40
47 work platform on derrick 40
48 pin/pin assembly of derrick 40
49 secondary fastline winch
50 lower portion of derrick 40
52 telescoping cylinder for derrick 40
60 BOP
70 injector
72 cradle of injector 70
74 hangar of cradle 72
76 first set of tracks of cradle 72
78 second set of tracks of cradle 72
80 cartridge assembly
82 reel for cartridge assembly 80
84 base of cartridge assembly 80
86 pillar of cartridge assembly 80
88 fluid swivel assembly on pillar 86
89 axle for reel 82
90 electrical collector on pillar 86
91 beam of cartridge assembly 80
92 drive motor for reel 82
94 spooler of cartridge assembly 80
96 track for spooler 94
98 arms for track 96
100 wireline winch assembly
102 wireline drum for assembly 100
110 control cabin for rig
112 scissor elevators for cabin 110
120 fluid/nitrogen pumper unit

Description of Preferred Embodiments

Reference is first made to FIGS. 1 to 4 which show a mobile rig (generally designated by reference numeral 20) for transporting drilling and servicing equipment to oil or gas well sites. The equipment is located aboard a self-propelled carrier 22 having a chassis or frame 24, a tandem axle front end 26, a triple axle rear end 28, a power unit or engine 29 for driving the front and/or rear axles, and a cab 30 with conventional controls for steering the carrier over a ground surface 21 and for locating the carrier's rear end near a well. The term "well" will be understood herein to mean either an oil or gas well to be drilled, or an existing well or wellhead (indicated by 15 in FIG. 12) which is to be tested or serviced in some way, as the case may be. The carrier incorporates a series of hydraulically operated stabilizers 32 (which important feature is described in greater detail below) for lifting the carrier 22 off the ground, some of which manipulate the carrier laterally relative to the well. It will be understood that the front and rear axle designs may vary, such as adding a third front axle, depending on the anticipated weight of equipment to be carried and the type of terrain to be encountered (e.g. sandy deserts, snow, swamps, etc.). It will also be understood that the carrier's design is generally symmetrical about its longitudinal axis.

An important aspect of the rig 20 is its incorporation of a number of drilling and servicing features aboard a single mobile carrier, including:

a derrick or mast 40 pivotally mounted to the carrier and being capable of supporting a blow out preventer 60 (referred to herein as "BOP");

an injector 70 supported by the derrick for moving continuous or coiled tubing (referred to herein as "CT") into and out of the well;

cartridge assembly 80 for holding various sizes of CT reel 82;

a winch assembly 100 for holding and manipulating wireline cable and testing equipment into and out of the well through the derrick; and, a control cabin 110 for controlling these and other rig features. Hence, an important advantage of the rig of the present invention over the prior art is that the rig 20 is designed to carry and manipulate the principle forms of tubing, namely both conventional joined pipe and CT for drilling and servicing existing wells, as well as wireline equipment. These services may be conducted overbalanced or underbalanced, and on vertical or slant wells. It is noted that an inventory of conventional pipe sections is not stored and transported on the rig 20 but aboard a separate carrier truck. These and other advantages will become more apparent below.

Figure 2:
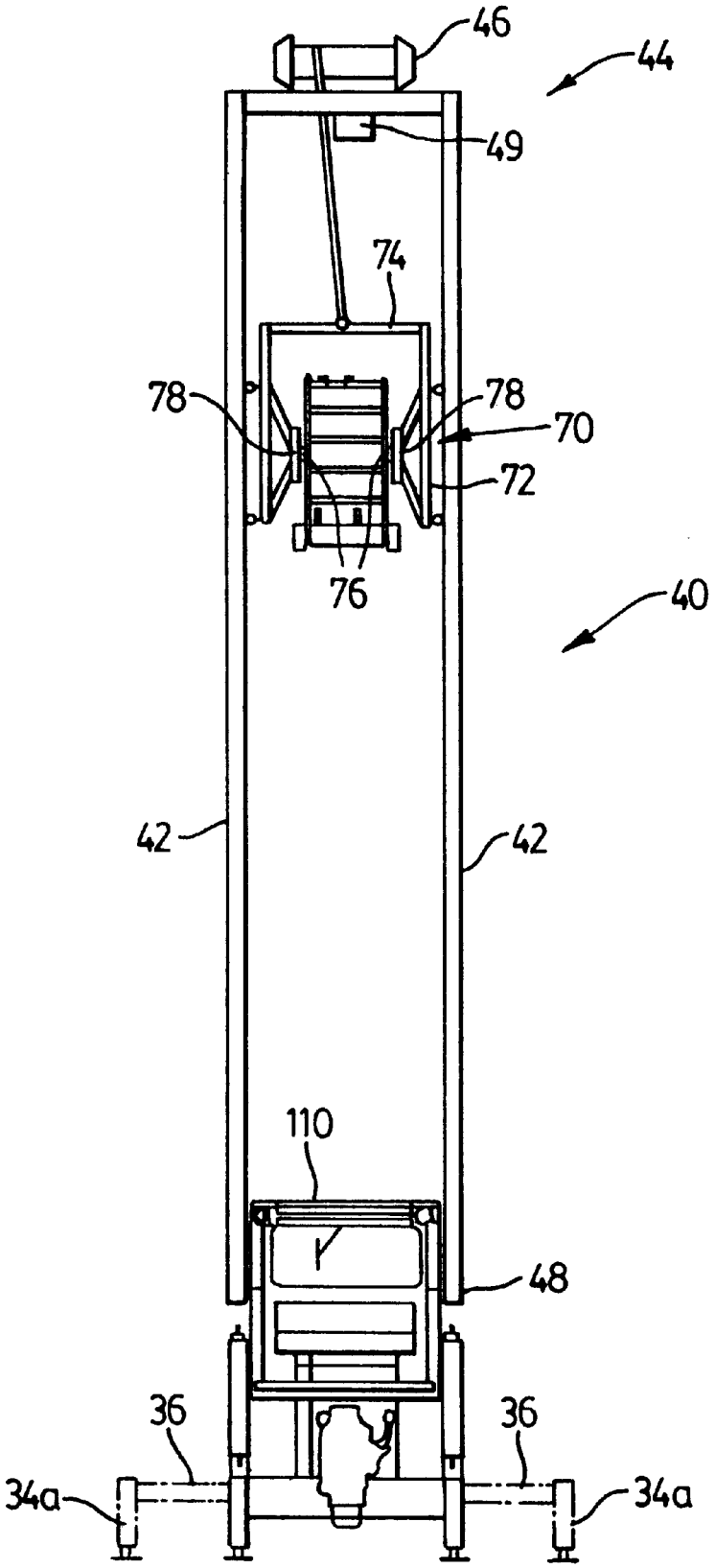
FIG. 2 is an end view of the rig of FIG. 1 with the mast elevated generally vertically.
Figure 4:
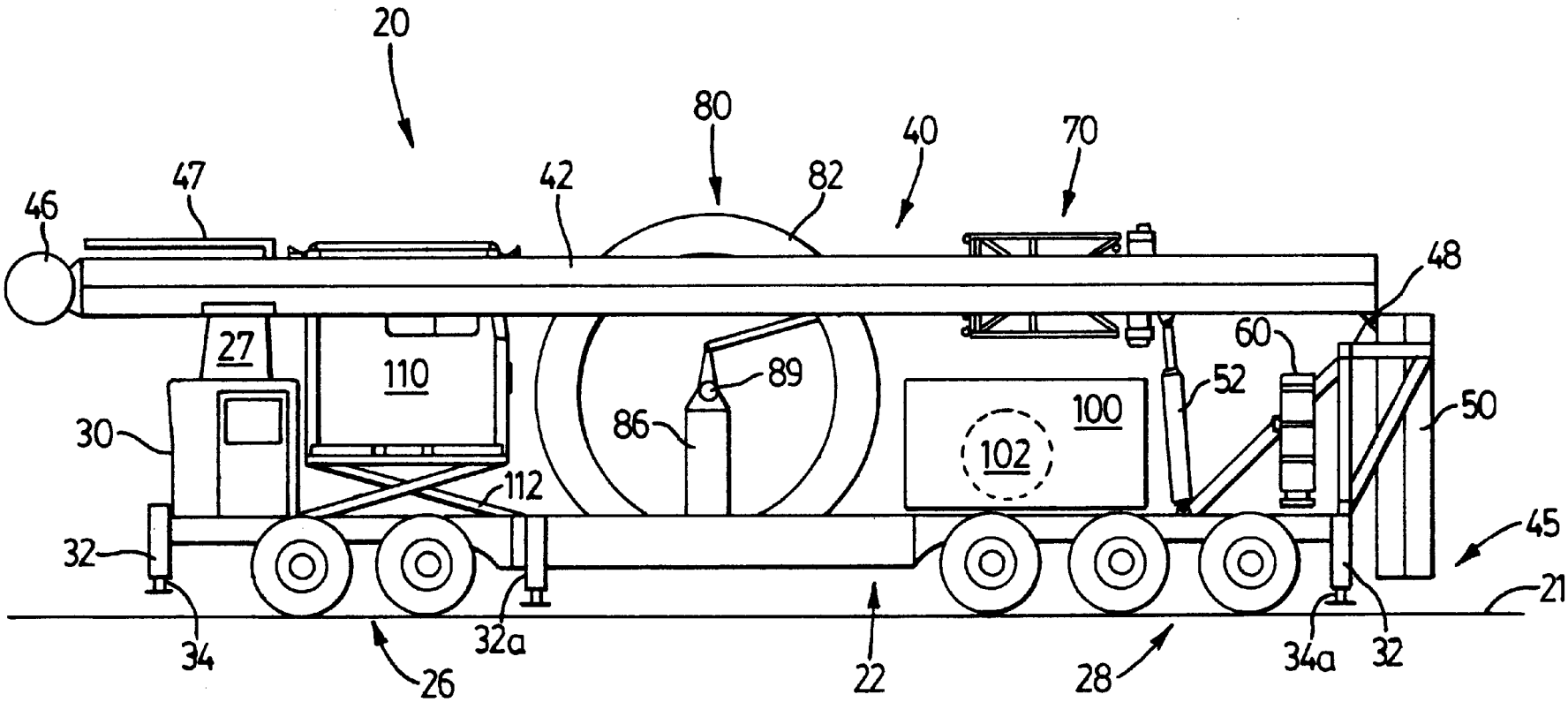
FIG. 4 shows the rig of FIG. 1 in a transportation mode with the mast in a generally horizontal reclined position.

Referring again to the carrier 22, the carrier's generally rectangular deck or platform carries a number of stabilizers 32 at each corner for stabilizing the rig during operation, particularly on uneven terrain. Depending on the size and weight of the rig, intermediate stabilizers 32*a* may also be provided, as indicated in FIG. 4. Each stabilizer 32 incorporates a vertically extendible hydraulic jack or lifter 34 for engaging the ground 21 to level the rig as desired, thereby removing some or all of the rig's weight from the front and/or rear end axles 26, 28. As best seen in FIG. 2, the rear end 28 of the carrier includes an extra set of lifters 34*a* mounted on generally horizontal, hydraulically extendible beams or frame members 36 which slide relative to the carrier deck. The beams 36, which are controlled from a control panel on the rear deck of the carrier (i.e. near the rear stabilizers 36), can move the rear end of the carrier laterally to the well, namely generally transversely to the longitudinal axis 23, to enhance alignment of the rig, and specifically the derrick, with the well.

Referring next to the derrick 40, it has two longitudinally spaced rails 42 (as best seen in FIG. 2) joined by a structural tie at the top end or crown 44 where a conventional derrick winch 46 is located for performing multiple functions such as raising and lowering the injector 70 and a lubricator, as well as running joined pipe segments if required. A secondary fastline winch 49 may also be located at the crown 44 for manipulating the BOP 60. The fastline winch 49 is preferably controlled from the above noted control panel at the carrier's rear end so that the operator has a good clear view of the BOP and wellhead during alignment procedures. The fastline winch 49 may also be used for sliding an adjustable platform 47 along the derrick for use by rig personnel to work above a well to prepare the wellhead for BOP installation. The platform 47 is shown in FIG. 4 in its folded/retracted mode near the derrick's top end 44 for transport, and in FIGS. 5–7 in its working position near the BOP above a well.

Referring now to FIGS. 1 and 4–6, the derrick shown is about 60 feet in length so as to accommodate multiple sections of conventional joined pipe. The derrick also supports the CT injector 70, and is pivotally mounted to the carrier 22 via a pin assembly 48 on each rail 42. A telescoping derrick cylinder or leg 52 is attached to each rail, and is operated from the control panel at the rear of the carrier, to tilt the derrick 40 between a transportation mode and an operating mode. In the transportation mode the derrick is brought to a reclined or lowered position (FIG. 4) where the derrick rests generally parallel to the carrier deck on one or more carrier supports (e.g. support 27 near the carrier's front end 26) for transporting the rig between well sites. In order to bring the derrick close to the carrier deck, the derrick rails 42 are spaced such that they fit on either side of the control cabin 110 and the cartridge assembly 80. As shown in FIG. 4 the derrick 40 is split in the vicinity of the pin assembly 48 to vertically collapse a lower portion or gooseneck extension 50 in the transportation mode so that the derrick's bottom end 45 does not protrude unduly from the carrier, thus reducing the risk of damaging the lower portion during transport. Prior to collapsing the lower portion 50 the BOP 60 is lifted off the wellhead by the fastline winch 49 and is placed on the carrier's rear deck just behind the wireline winch assembly 100 (as shown in FIG. 4), and the injector 70 is lowered so as not to interfere with the control cabin 110 and cartridge assembly 110 upon reclining the derrick. The injector remains with the derrick during transport and need not be removed.

In the operating mode the derrick is tilted to any one of a number of inclined positions relative to the carrier and ground surface to bring the derrick into general parallel alignment with the well, such as a slant mode (FIG. 5) for operating on slant wells, and a vertical mode (FIG. 6) for vertical wells. During operation the derrick's gooseneck extension 50 is secured to the main upper part of the derrick so that the BOP may be located on the lower portion where required. The derrick of the present invention is further capable of being slanted beyond the vertical mode, namely into an "over-center" position (shown in FIG. 1), to compensate for uneven ground conditions and thus enhancing the derrick's well alignment capabilities. Further, such over-center tilting is beneficial for wireline work since the wireline equipment which hangs from the derrick is kept back from the rear end of the carrier and out of the plane of the derrick in the vicinity of the wellhead.

Figure 5:
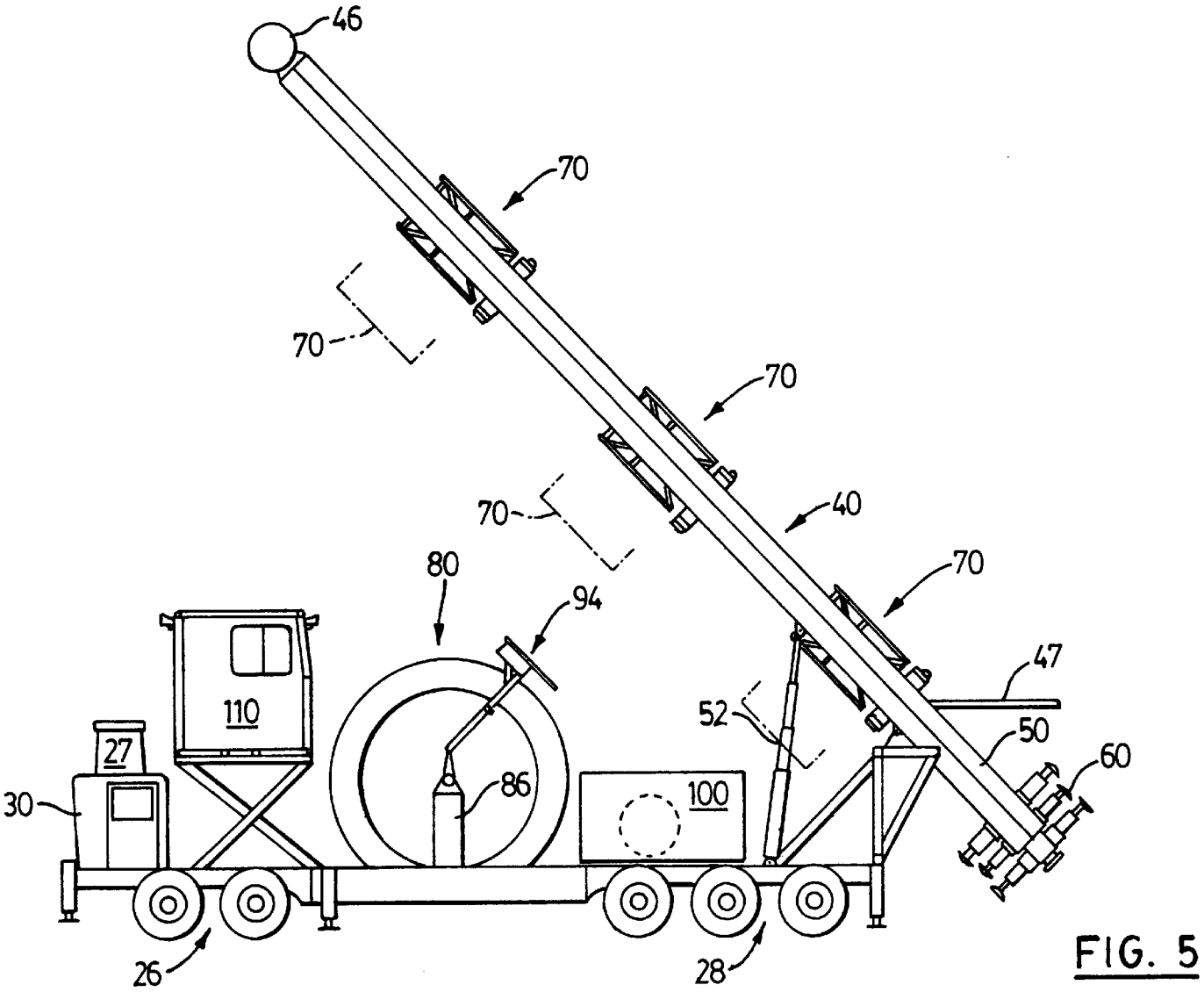
FIG. 5 shows the rig of FIG. 4 with the mast in a slant operating mode for manipulating continuous tubing into and out of an inclined well, with an injector located at some selected positions along the mast, and with a control cabin raised to provide an operator with a better view of operations at a wellhead.
Figure 6:
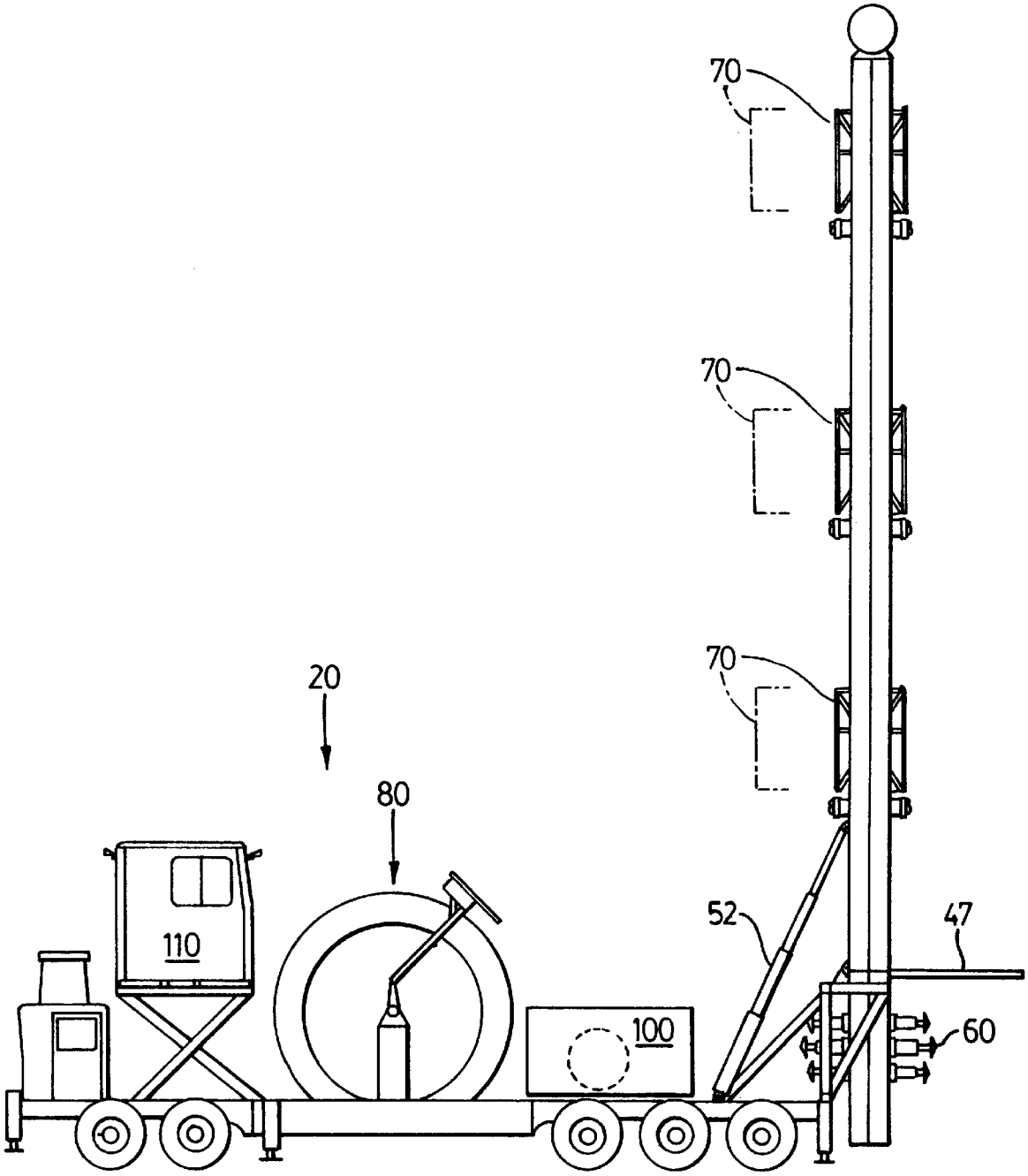
FIG. 6 shows the rig of FIG. 5 with the mast in a vertical operating mode.
Figure 7:
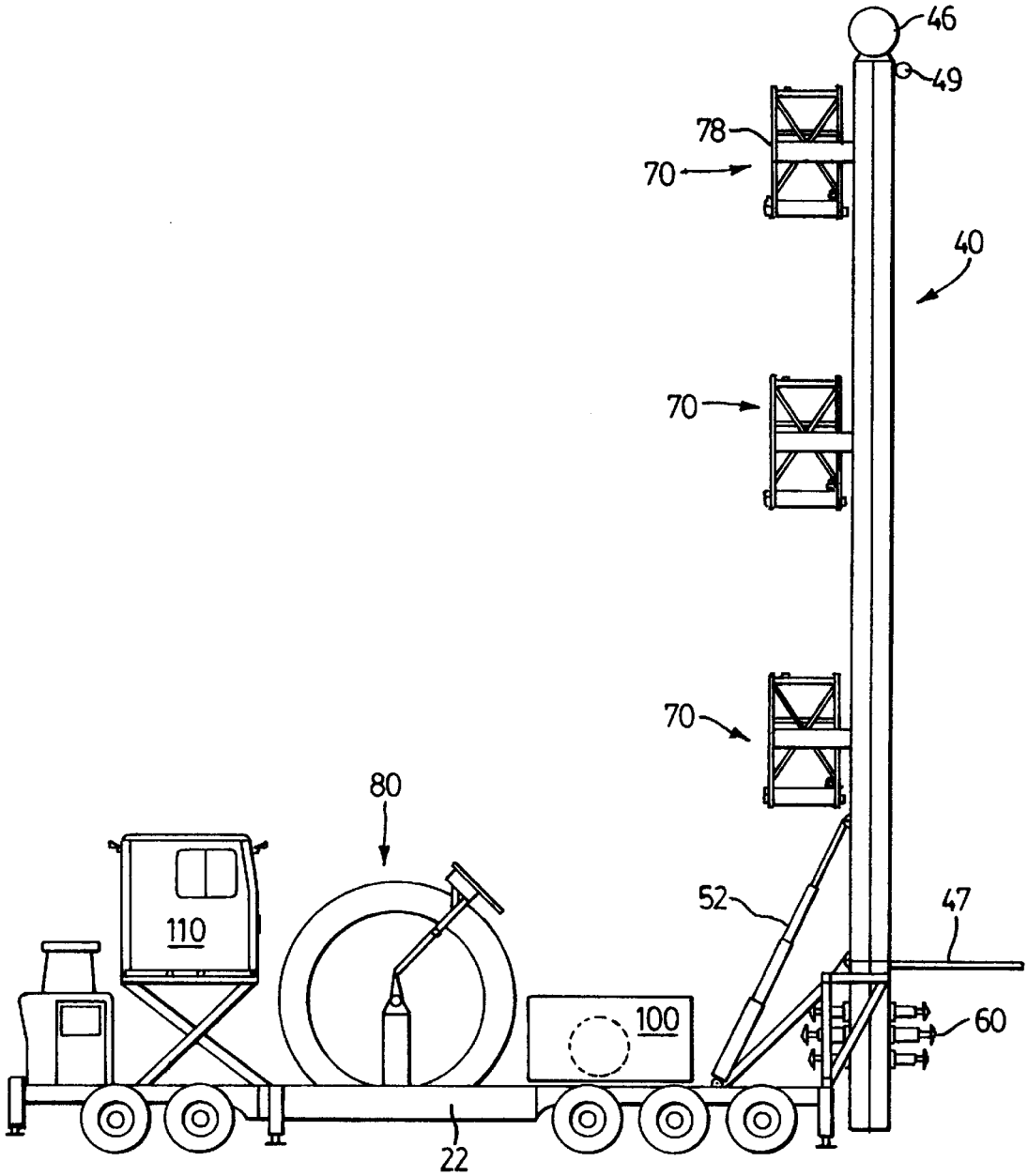
FIG. 7 shows the rig of FIG. 6 with the injector (at three selected positions) displaced laterally to allow the mast to handle conventional joined pipe.
Figure 10:
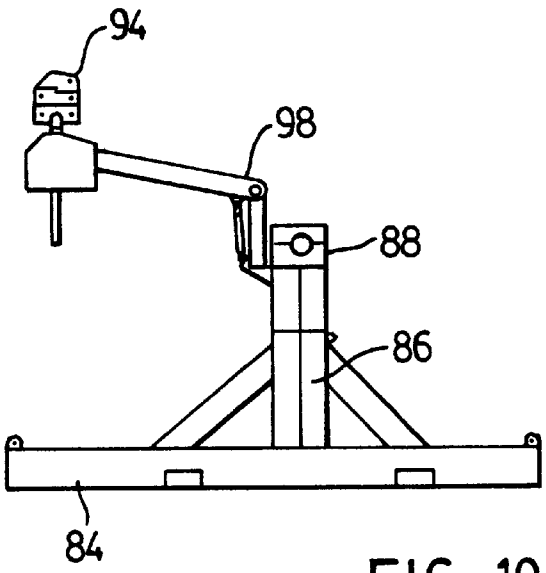
FIG. 10 shows the cartridge assembly of FIG. 8 from the opposite side and with the reel removed.
Figure 9:
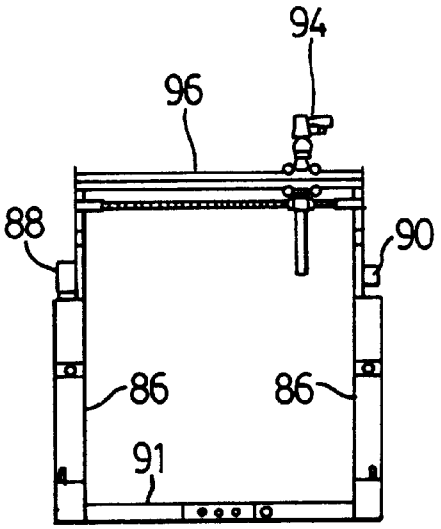
FIG. 9 is an elevated end view of the cartridge assembly of FIG. 8.
Figure 8:
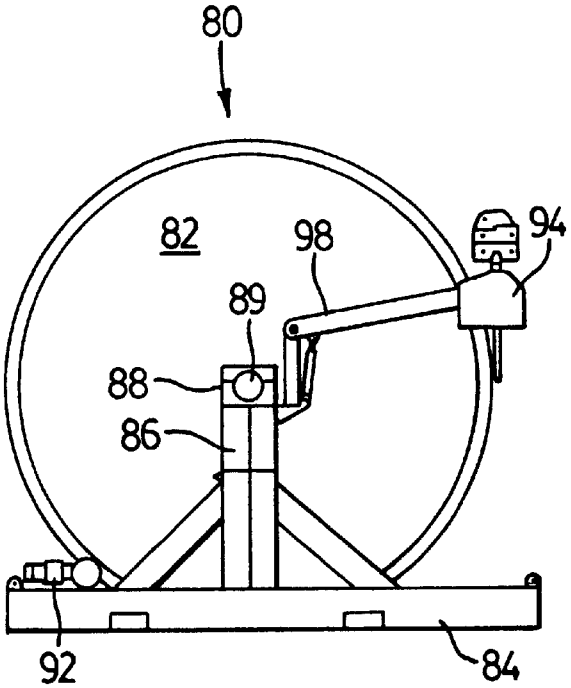
FIG. 8 is a close-up, elevated side view of a cartridge assembly according to a preferred embodiment for holding a reel of continuous tubing on the rig of FIG. 1.
Figure 11:
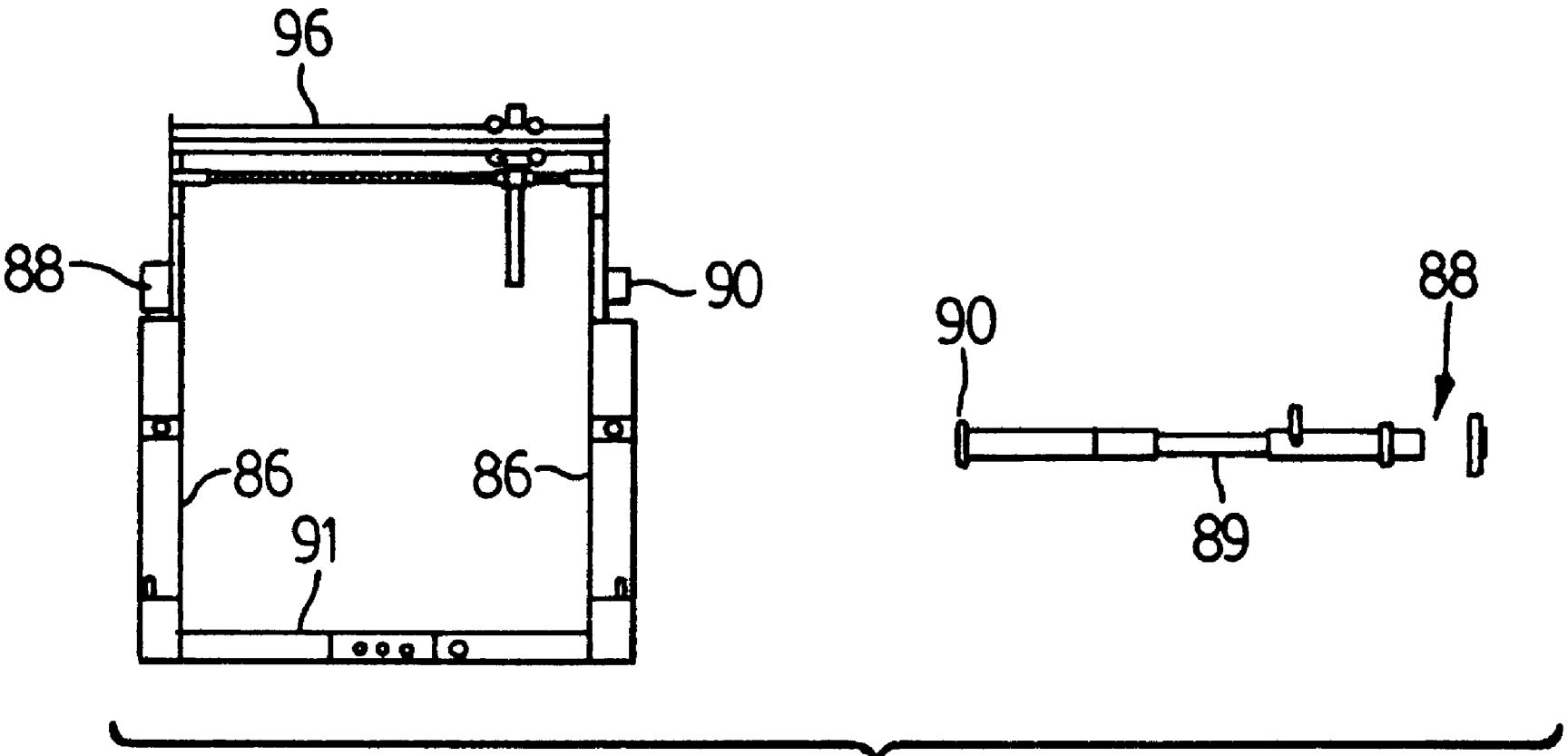
FIG. 11 is an isolated view of a shaft placed through the reel of FIG. 8; and, FIG. 12 is a plan view of a pumper unit for use with the rig of FIG. 1.

A cradle 72 (FIG. 2) for supporting the injector 70 rides on the derrick's rails 42 to move the injector to a desired location along the derrick, with some selected locations being illustrated in FIGS. 5–7. An inverted unshaped hangar 74 extends above the cradle and is attached to a cable from winch 46 for sliding the cradle and injector along the derrick. The cradle has two sets of tracks to help align the injector with the well, namely a first set of tracks 76 for sliding the injector transversely between the rails 42 (i.e. within the plane of the derrick formed by its rails 42), and a second set of tracks 78 for moving the cradle and injector laterally (i.e. perpendicularly to the plane of the derrick) out of the derrick. In the embodiment shown, the second set of tracks 78 provide up to 48 inches of lateral movement, and the cradle is capable of traveling along the mast whether the cradle is located within the derrick or slid laterally out of the plane of the derrick. The extent of the lateral movement is indicated by dotted outlines in FIGS. 5&6, and FIG. 7 shows the injector at selected elevations moved laterally away from the derrick by the cradle 72. Such lateral movement, combined with the cradle's ability to slide on tracks 76 and along the derrick's rails 42, provides the injector with a "3-D" (i.e. 3-dimensional) manipulating capability for alignment with the well. Moving the injector out of the plane of the derrick also frees the derrick for running conventional joined pipe if desired, such as for shallow well drilling applications, without the need for complete removal of the injector from the rig.

It is noted that for slant operations the BOP is supported from the bottom of the injector cradle 72 for sliding the BOP over an inclined wellhead for hook-up.

The cartridge assembly 80 is located between the front and rear axle sets 26, 28 so that the assembly can sit low on the chassis to keep its center of gravity as close to ground level as possible, while still allowing for the power train and other rig components to extend underneath the chassis as required. An important feature of the cartridge assembly is its adjustment capability to accommodate most commercially available CT reels. Prior art cartridge assemblies are reel specific, namely they only accept a reel designed for that particular cartridge, often requiring CT to be re-spooled from its shipping reel to the cartridge specific reel. In the present invention the cartridge assembly 80 can be adjusted to accept virtually any shipping reel 82 which carries 1 inch to 2⅞ inch CT, resulting in considerable savings in time and money, and eliminating damage to CT from re-spooling.

Figure 1:
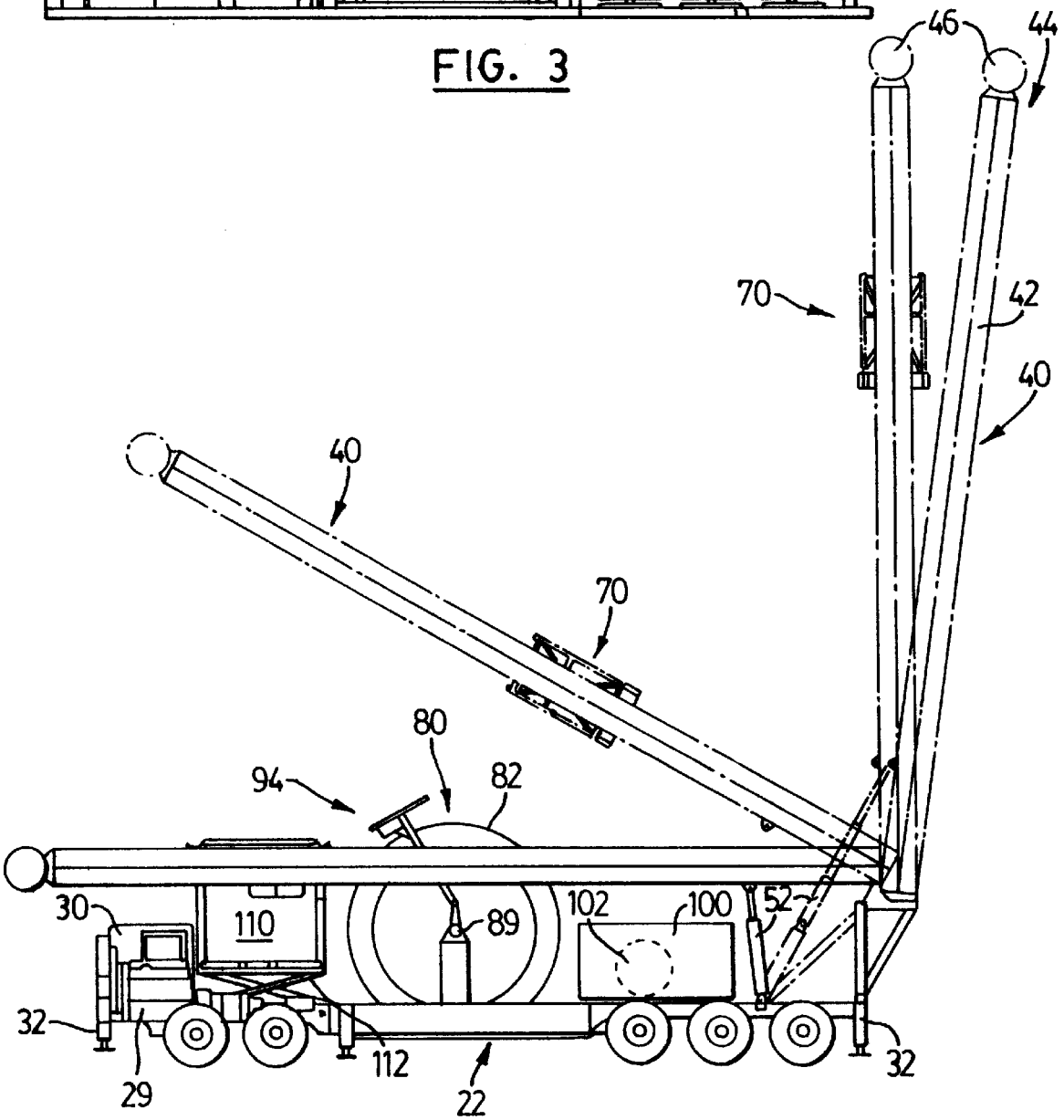
FIG. 1 is a side view of the rig according to a preferred embodiment of the present invention showing various selected inclinations of a mast carried by the rig.

The cartridge assembly 80, shown in greater detail in FIGS. 8–11, has a base frame member 84 for mounting to the rig chassis, and upstanding pillars 86 capped by a fluid swivel assembly 88 which includes an axially extendible axle 89 for conforming to the width of the reel and rotatably carrying the reel 82 atop the pillars 86. The ends of the axle 89 have a bearing pack, and a collector 90 is located at least at one end for electrical transmission between the control cabin and equipment at the end of the CT. The pillar 86 is vertically adjustable to suspend the axle and reel above the floor of the cartridge assembly for unobstructed rotation of the reel. A slidingly adjustable beam element 91 extends between the pillars 86 for spacing the pillars to conform to the width of the reel 82 to be supported. A drive motor 92 for spinning the reel is connected to the base 84 is length adjustable to frictionally engage a peripheral edge of the reel 82. A levelwind assembly for spooling or guiding the CT off of and onto the reel has a hydraulic spooler 94 for handling CT in a known manner. The spooler travels along a track element 96 which is supported off of the pillars 86 by articulated arms 98 for adjusting the spacing of the spooler 94 from the reel 82. Depending on the inclination of the derrick 40 and the location of the injector 70 along the derrick, the levelwind assembly can be adjustably pivoted about the axle 89 through an angle of about 90 degrees or so (two positions of which are shown in FIG. 1) to provide a gentle arc to the CT being spooled into the injector, as illustrated by the broken lines in FIG. 1.

The winch assembly 100, also referred to as a wireline reel assembly, holds and manipulates a drum or reel 102 (shown in dotted outline) of wireline cable equipment. The wireline assembly ties into the rig's existing support systems, both hydraulic and electrical, to allow the rig to operate as a wireline facility. The wireline cable is directed into the well directly from the winch assembly 100 through a wireline shieve mounted at the derrick's crown 44. The wireline winch assembly allows the rig to be used in "vertical" production logging and perforating (i.e. in slightly deviated wells with less than a 60 degree inclination). The winch assembly may be removed from the chassis when not needed, simply by removing the assembly 100 with a forklift or crane. It is noted that the CT reel 82 may be used in place of the wireline winch & drum to address production logging and perforating in horizontal and highly deviated wells (i.e. greater than 60 degree inclination).

The control cabin 110 allows an operator to control most rig functions from one location, such as operation of the derrick, cartridge assembly, CT, winch assembly, and wireline equipment, which simplifies and accelerates rig set up operations. The cabin is mounted on scissor elevators 112 to provide the operator with a view toward the well area over the cartridge and winch assemblies 80, 100. The cabin is lowered for transport (see FIG. 4).

The control cabin 110 houses various computer systems for rig control and operation. In the preferred embodiment, three principle computer systems are employed. The first computer system controls and monitors the carrier and the CT assembly, as well as a separate fluids/nitrogen pumper truck 120 (discussed below). Hence, from a single location, an operator can adjust the speed of pumps for fluids/nitrogen delivery to the well, manipulate the fluid manifold, monitor all engine functions (e.g. coolant levels, oil pressures, etc.) and operate the CT and BOP systems. The first computer also records the parameters of the drilling/servicing work being performed, such as fluid pressures, annulus pressure, CT string weight, flow rates, and volume of pumped fluids. These parameters an then be presented to the client for post job review. The first computer system can therefore also manage inventory aboard the rig, such as letting the operator know when an oil filter must be changed, how many oil filters remain in inventory, and when more filters must be ordered. This feature is particularly useful when working in isolated areas, such as the arctic or remote deserts.

A second computer system is used to power and communicate with the CT string or a bottom hole assembly ("BHA"). This surface system powers the BRA at the end of the CT string via a co-axial cable running through the center of the CT string. These tools include magnetometers and inclinometers for direction and inclination control, respectively. The system may also decipher gamma ray data for directional drilling using geosteering. The BHA may also accumulate data such as bottom hole pressure and temperature, as well as the weight on the bit.

A third computer system is used for production logging and perforation. Whereas production logging/perforating until now required a CT unit and separate production logging truck, the present invention uniquely incorporates such functions on one rig. Combining such a "surface" computer system with the derrick 40 and wireline winch assembly 100 provides an efficient and cost effective delivery of services over existing methods. In the present invention, for example, a single rig is used for perforating on wireline or CT, underbalanced or overbalanced, and on slant wells.

Figure 12:
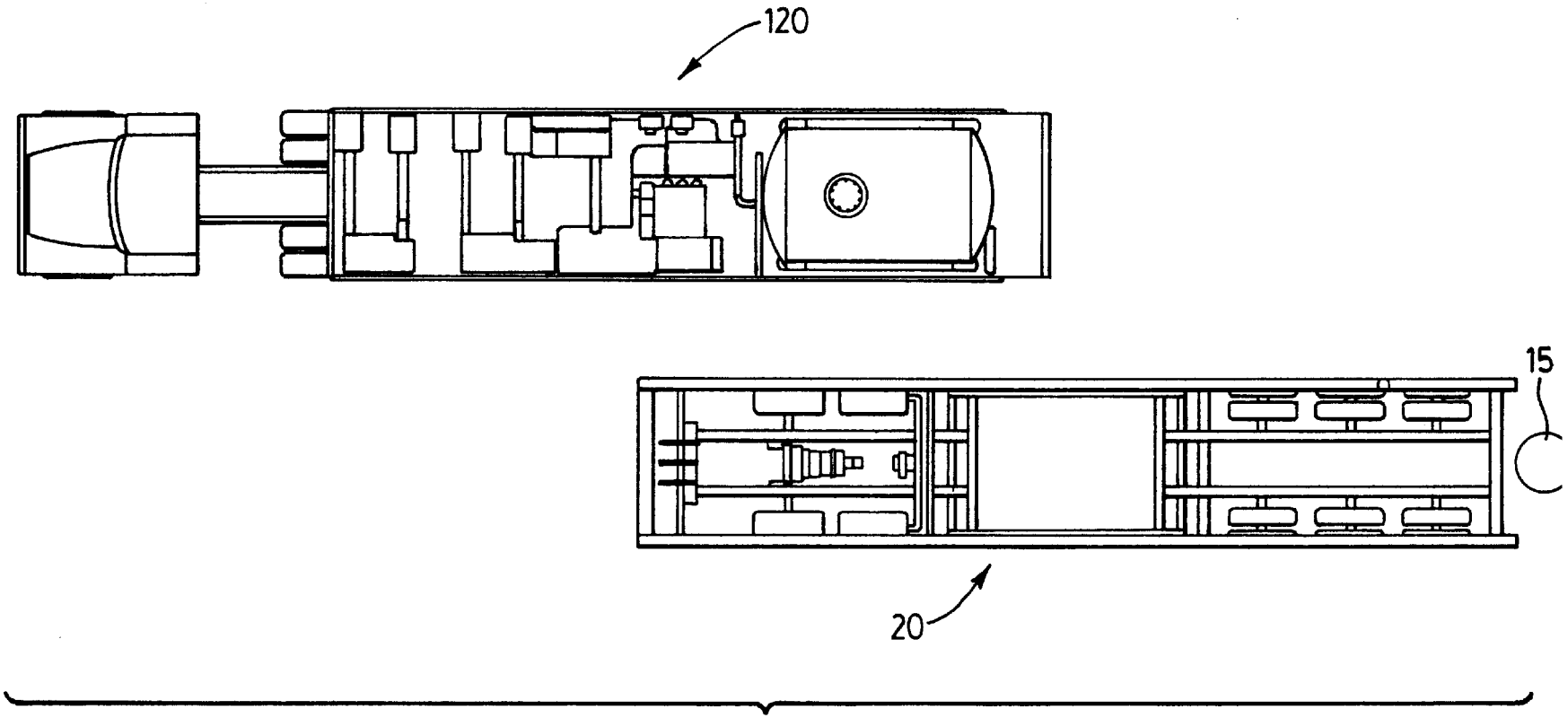

Referring lastly to FIG. 12, a fluid/nitrogen carrying pumper unit 120 may be used in conjunction with the rig 20 to supply the necessary materials for cleaning or enhancing pumping of the well. A swing-out arm on the pumper unit is used to operatively connect the pumper unit 120 to the rig 20.

A typical rig-up procedure for the rig 20 may is now described. The rig 20 and combi pumper unit 120, each operated by one crew member, are brought to a well site. The rig 20 is spotted over a wellhead and the rig stabilizers 32 are used to confirm adequate alignment with the wellhead for construction of wellhead and injector components. This alignment may be confirmed with a plumbob device mounted on the rear of the rig. The control cabin 110 is then elevated, and the derrick 40 is raised at the same time as the gooseneck extension 50 travels out into alignment with the wellhead. The work platform 47 may next be lowered from the crown using the secondary fastline winch 49 to a location just above the wellhead and folded out to a generally horizontal position from which the wellhead may be prepared for BOP 60 installation. The BOP is then lifted off the BOP stand at the rear of the carrier using the fastline winch, is positioned on the wellhead, and is secured with flange bolts. The mainblock winch 46 is lowered to the injector 70 which is unlocked and lifted from its locked transportation position, thus allowing the injector to travel between the BOP and the derrick's crown using the winch 46. Depending on the location of the BOP, the injector should be free to travel about 40 feet (12.1 m) or so.

The rig is now in a position to install the lubricator and BHA. The lubricator is connected to the injector which in turn is lifted by the injector cradle 72 until a desired lubricator length (up to 40 feet) is installed via Bowen connection. CT is then run through the lubricator until a CT connector protrudes from the bottom end of the lubricator. The CT connector should be installed on the CT prior to arrival on location according to standard practice. The BHA is affixed to the protruding CT connector and the CT is pulled out of hole until the entire BHA has been pulled into the lubricator. A function test may now be performed to ensure the BHA tools are functioning properly. The injector next travels from this "make-up" position to a "work" position over the wellhead, namely until the Bowen connection made atop the BOP. In drilling applications a kill line must be hooked up. The combi pumper 120 is brought along side the rig 20 for electrical and/or nitrogen hook up, at which point the rig is ready for pressure testing and subsequent. The reverse procedure is followed to bring the rig to its transportation mode upon finishing work at the wellhead. Similar procedures are followed for operations using joined pipe sections, although the injector is moved laterally out of the derrick to allow the winch 46 to manipulate the pipe sections.

The operation and further advantages of the rig 20 should now be better appreciated, particularly to those in the oil/gas well drilling and servicing industry. The single rig 20 is multi-tasking in that it can be used for CT services, CT drilling, conventional joined tube drilling, and selected wireline services for well production testing and perforating. A summary of some the rig's uses and capabilities is set out below:

a) conventional CT:
- i) cleanouts
- ii) scale/wax removal
- iii) acid treatments
- iv) cement placements
- v) CT completions
- vi) horizontal production testing
- vii) horizontal perforating b) CT drilling:
- i) vertical re-entries
- ii) window milling
- iii) directional re-entries
- iv) shallow vertical wells (i.e. those generally less than 1000 m (about 3300 ft.) below surface)

c) wireline services
- i) production logging
- ii) perforating
- iii) miscellaneous conventional wireline work All of the above services may be conducted by the rig 20 either overbalanced or underbalanced, and on slant wells.

Hence, although the rig 20 is smaller and more compact than existing CT rigs, it addresses the same work scope as the existing rigs and numerous additional functions which the existing rigs lack, such as wireline work, slant drilling and ability to work underbalanced. The rig of the present invention is particularly suitable for shallow well drilling, and the single rig provides one with the option of completing a well using either CT or joined pipe.

Further, CT units are typically built on the deck of a truck or on the trailer of a semi-truck. The rig 20 is the first of its kind to be built on a service rig chassis, although the frame, suspension, power train, etc. had to be designed to accommodate CT cartridge assembly. As noted earlier, for instance, the reel 82 had to be positioned in a manner so that the carrier's driveshaft was left with sufficient ground clearance.

The derrick 40 of the present invention incorporates a winch 46 and injector 70 on a derrick as one unit, yet remains lightweight and maneuverable compared to prior art derricks which do not carry such features. In particular, the injector remains with the derrick at all times, including during transport, whereas prior derricks require its removal and often a separate truck for its transport. The derrick 40 and cabin controls should provide a set up time onto a well in 5 minutes or less, in a virtually hands-free operation.

The ability of the adjustable cartridge assembly 80 to accept any one of a variety of shipping reels on which CT arrives at a well site omits the logistical nightmare of respooling the CT onto a work reel mounted on a CT unit. The savings in time and costs is considerable, particularly because an additional work reel for respooling need not be purchased by the CT unit operator (the capital cost of some work reels being in the range of US$100,000).

The rig can be easily maneuvered into alignment over a well using the system of stabilizers 32, either alone or in conjunction with the tiltability of the derrick and the 3-D maneuverability of the injector and cradle 70, 72.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below. For example, the rig may be used in application other than for oil/gas wells, such as for subterranean river crossings, drilling under roadways and city blocks, etc., particularly when used in combination with the pumper unit 120.

I claim:

1. A rig for drilling and servicing a well comprising:

(a) a mobile carrier;

(b) a mast mounted on said carrier, said mast including:

(i) means for pivoting said mast between a transportation mode where said mast is in a reclined position for transporting said rig to said well, and an operating mode for inclining said mast generally parallel to said well for said drilling and servicing; and, (ii) an injector slidable to selected positions along said mast for moving tubing into and out of said well;

(c) a cartridge assembly mounted on the carrier for holding a reel of continuous coiled tubing, said cartridge assembly including a means for guiding said coiled tubing between said reel and said injector;

(d) a winch assembly removably mounted on said carrier for holding and manipulating wireline equipment into and out of said well; and, (e) a control cabin mounted on said carrier for controlling rig functions, including said mast, injector, cartridge assembly, coiled tubing, winch assembly, and wireline equipment.

2. The rig of claim 1 wherein said mast is adapted to selectively accept conventional joined pipe and said coiled tubing for drilling, producing and testing said well.

3. The rig of claim 2 wherein said mast includes a cradle for sliding said injector along said mast, said cradle being further movable laterally to said mast for displacing said injector (a) away from the mast to allow said mast to handle said conventional joined pipe and (b) into alignment with said mast so that said injector may be used to manipulate said coiled tubing.

4. The rig of claim 1 wherein said mast includes means for maneuvering said injector and tubing into alignment with said well.

5. The rig of claim 4 wherein said means for maneuvering comprises a cradle for sliding said injector along a longitudinal axis of said mast and for moving said injector in a plane orthogonal to said longitudinal axis.

6. The rig of claim 1 wherein said means for pivoting pivots said mast to at least a vertical orientation relative to said well.

7. The rig of claim 6 wherein said means for pivoting is further adapted to provide an angle of inclination between said carrier and mast of greater than 90 degrees.

8. The rig of claim 1 wherein said cartridge assembly includes an adjustable frame for accepting and holding a plurality of sizes of said reel.

9. The rig of claim 8 wherein said adjustable frame includes vertically adjustable pillars for accepting and supporting said reel therebetween, and an adjustable elongate base support member extending between said pillars for providing an appropriate spacing between said pillars to accept said reel.

10. The rig of claim 9 wherein a drive motor located on said adjustable frame is slidably adjustable to engage a circumferential edge of said reel to rotate said reel in said cartridge assembly.

11. The rig of claim 9 wherein said means for guiding comprises a spooler operable on a track member, and arm means for supporting said track member on said adjustable legs, said arm means being articulated to adjust the spacing of the spooler from the reel being located in the adjustable frame.

12. The rig of claim 1 wherein said carrier has a stabilizer means for lifting said carrier from its ground support and for manipulating said carrier relative to said well.

13. The rig of claim 12 wherein said stabilizer means comprises at least one pair of vertically adjustable hydraulic lifters located at longitudinally opposed ends of said carrier, at least some of said lifters having a frame member slidably engaged to said carrier for moving said carrier generally laterally relative to said well.

14. The rig of claim 1 wherein said carrier is adapted to carry and transport a blow out preventer to said well, and said mast includes a first winch to manipulate said blow out preventer for mounting onto said well.

15. The rig of claim 14 wherein said mast includes a second winch for raising and lowering said injector and for running conventional joined pipe.

16. The rig of claim 2 further including a pumper unit for supplying fluids to said conventional joined pipe and coiled tubing for drilling and servicing of the well.

17. The rig of claim 1 wherein said control cabin houses a first control means for generally controlling and monitoring at least the carrier and the cartridge assembly, a second control means to power and communicate with at least the coiled tubing and a bottom hole assembly located on said coiled tubing, and a third control means for production logging and perforation operations.

18. A mobile rig for drilling and servicing an oil or gas well comprising:

a self-propelled carrier;

a mast mounted on said carrier, said mast including:

means for pivoting said mast between a lowered transportation position for transporting said rig to said well, and an raised operating position for inclining said mast to said well; and, an injector having an operative position wherein said injector is movable to a plurality of selected locations along said mast for threading continuous coiled tubing into and out of said well, and an inoperative position wherein said injector is displaced away from said operative position to allow said mast to accept and operate conventional joined pipe.

19. The mobile rig of claim 18 wherein the mast has two longitudinally spaced rails along which said injector is movable, a top portion with a joined pipe handling means, a bottom portion for location adjacent said well, and an operative plane generally defined by said spaced rails and said top and bottom portions, wherein in said operative position said injector is generally located in said operative plane, and in said inoperative position said injector is displaced out of said operative plane.

20. The mobile rig of claim 19 wherein said mast includes a cradle slidably mounted on said rails for moving said injector along said mast in said operative position, said cradle having a second track element slidably mounted to said injector for sliding said injector laterally to said mast to said inoperative position.

21. The mobile rig of claim 19 wherein said injector further includes a first track element for aligning said injector with said well.

22. The mobile rig of claim 21 wherein said first track element comprises a cradle for moving said injector along a longitudinal axis of said mast and for sliding said injector transversely between said spaced rails.

23. The mobile rig of claim 18 wherein joined pipe handling means comprises a mainblock winch, and said top portion of the mast further includes a platform winch for raising and lowering a blow out preventer carrier aboard said carrier.

24. A rig for drilling and servicing a well comprising:

a mobile carrier;

a mast mounted on said carrier, said mast including a means for pivoting said mast between a reclined position for transporting said rig to said well, and a raised position for inclining said mast generally parallel to said well, and an injector movable to selected positions along said mast for moving continuous coiled tubing into and out of said well, a cartridge assembly mounted on the carrier for holding a reel of said coiled tubing, said cartridge assembly including a guide means for guiding said coiled tubing between said reel and said mast, an adjustable frame means for accepting and holding a plurality of sizes of said reel and a drive motor located on said frame means slidably adjustable to engage a circumferential edge of said reel to rotate said reel in said cartridge assembly; and, a control means for controlling the function of said mast, cartridge assembly and coiled tubing.

25. The rig of claim 24 wherein said adjustable frame means includes vertically adjustable pillars for accepting and supporting said reel therebetween, and an adjustable elongate base support member extending between said pillars for providing an appropriate spacing between said pillars to accept said reel.

26. The rig of claim 24 wherein said guide means comprises a spooler operable on a track member, and arm means for supporting said track member on said adjustable legs, said arm means being articulated to adjust the spacing of the spooler from the reel being located in the frame means.

* * * * *